United States Patent [19]

Uhlig

[11] 4,351,443

[45] Sep. 28, 1982

[54] DUAL LIQUID TIGHT CLOSURES

[76] Inventor: Gerhardt E. Uhlig, 6539 Dorr St., Apt. L20, Toledo, Ohio 43615

[21] Appl. No.: 264,012

[22] Filed: May 15, 1981

[51] Int. Cl.[3] ..... B65D 55/02

[52] U.S. Cl. ..... 215/216; 215/350; 215/211

[58] Field of Search ..... 215/211, 216, 217, 350

[56] References Cited

U.S. PATENT DOCUMENTS

| | | | |
|---|---|---|---|
| 3,232,470 | 2/1966 | Gibson | 215/DIG. 1 |
| 3,331,523 | 7/1967 | Exton | 215/350 |
| 3,770,153 | 11/1973 | Gach et al. | 215/216 |
| 3,814,274 | 6/1974 | McIntosh | 215/344 |
| 4,117,945 | 10/1978 | Mumford | 215/216 |
| 4,134,513 | 11/1979 | Mumford | 215/216 |
| 4,138,028 | 2/1979 | Price et al. | 215/216 |
| 4,213,534 | 7/1980 | Montgomery | 215/216 |
| 4,280,631 | 7/1981 | Lohrman | 215/216 |

*Primary Examiner*—George T. Hall
*Attorney, Agent, or Firm*—Richard D. Emch

[57] ABSTRACT

A container and closure construction featuring double means of liquid tight-sealing with a threaded closure so arranged as to double seal combined or sequentially against two separate areas of the rim of a container neck to provide sealing properties even when closure is partially unscrewed from the top of the rim of the container. A preferred embodiment has its application of the above arrangement together with child proof safety closures having unique safety locking arrangements in the form of coincidentally registered abutments and projections formed in and/or on said container and closure which do not substantially interfere with applying the closure to the container but which can be disengaged only through purposeful mind-controlled dextrous manipulation.

20 Claims, 29 Drawing Figures

DUAL LIQUID TIGHT CLOSURES

This application is filed as an improvement to my previous patents:

Uhlig U.S. Pat. No. 3,830,391
Uhlig U.S. Pat. No. 3,984,021
Uhlig U.S. Pat. No. 4,116,351
Uhlig U.S. Pat. No. 3,917,097
Uhlig U.S. Pat. No. 3,949,893

BACKGROUND OF THE INVENTION

In general:

The present invention contemplates improvement over prior art described in the following patents.

Mumford U.S. Pat. No. 4,134,513
McIntosh U.S. Pat. No. 3,814,274 concerning double sealing of threaded closures.

DESCRIPTION OF THE IMPROVEMENT

In general and for the purpose of explaining the improvement of the present invention with respect to their usage within the scope of the patented Uhlig U.S. Patent Documents, all the embodiments therein described and taught have a child proof safety closure feature in commin, this feature being that a one piece closure threadingly engages a threaded closure neck until it liquid seals upon a primary closure sealing-means, upon unscrewing of this type of closure, certain abutments on closures and containers prevent the closure from being removed after the primary liquid seal is out of contact. It is these child proof deterrent means which by way of registering dents and projections formed on said closures and containers which engage easily and disengaged only through purposeful mind-controlled manipulation thereof coupled with flexing of closure to accomplish said disengagement.

There is a consistent handicap in all of these various embodiments which requires improvement.

A critical leakage dimension in the vertical axis of the closure container package occurs when the closure is unscrewed from the container and its primary seal or cap liner until it arrests on the abutments of said safety features for child resistant purposes. If by any chance the user will lay the package horizontally, contents can seep out or leak from package, while the closure is not yet removed from the packaged retained by the safety abutments. This may become a messy situation resulting in caking or thread portions by drying up of container contents, etc., while the package may still be substantially child safe as to total access of contents, prior to disengagement of safety arrests. However, for certain products the package does not qualify as a leak proof closure package, on account of this above described critical leakage dimension!

As a definition for closure seals, the primary seal may be considered the inner closure ceiling that contacts the container neck rim top with or without a liner application which inserted liners may serve as a leak proof component.

A secondary seal may be considered as a sealing means that prevents the closure from leaking in the critical leakage dimension on the vertical axis of the package after the primary seal is broken while the closure is yet prevented from removal because the safety abutments on closure and container are so preventing it.

SUMMARY OF INVENTION

It is the general object of the present invention to provide an improvement in the art of dual sealing arrangements. This invention relates to double sealing means operating simultaneously or sequentially upon partial unscrewing of threaded closure-cap engageable upon threaded container neck.

It is an object of the invention to provide a closure-container combination featuring double means of liquid-tight-proofing inside a threaded closure so arranged as to seal together when the closure is fully capped upon a container neck or sequentially upon partial removal of the closure or upon loosening of capping torque pressure on top of the neck-rim of the container.

It is a primary object of the present invention to provide a sealing combination that is liquid sealing a closure cap even if the cap has come loose from its torque pressure which was initially applied on to closure in its capping operation.

It is a further object of the present invention to provide a closure of the above type to be used in combination with one piece child proof safety closures of the order of the Uhlig Patents as tabulated above.

In this kind of closure-container combinations it is desired that the sealing engagement between the cap and the container be maintained not only upon full tightening of the cap but also within the entire axial range of displacement of the closure from the fully tightened position to a position at which the locking mechanism is engaged. In other words, it is desirable to maintain the contents of a container sealed even if the cap is in a partly released position.

It is a very advantageous object of the present invention to provide sealing properties that are not subjected to substantial plastic memory phenomena or loss of dynamic-lip tension upon removal of closures after prolonged shelf life of packages.

GENERAL DESCRIPTION

A particular embodiment with reference to drawing FIGS. 1 to 4 has its application with the use of liner inserts. The present invention utilizes a single liner in two ways, namely as a primary and secondary seal. It is preferred that the liner be produced from a material which is capable of becoming deformed by application of axial pressure between the cap and the bottle neck; the achievement of the suitable shape rendering the liner operative can be effected by appropriately designing the shape of the cooperating parts of the constant neck rim and the container top wall, as will be explained hereinafter.

A resilient and deformable liner disc is mechanically placed into the closure cap.

The liner disc is meant to become deformed by way of the capping force which is a strong wedge type force when the closure is being applied on to the container neck. It will be apparent by looking at the respective drawings FIGS. 1 to 4 that a generally cylindrical container rim is greater in diameter than a circular forming protrusion arrangement inside the cap, it is greater by the approximate double of the liner disc thickness. When the liner hits home by way of capping the closure on to the container neck with automatic capping equipment, the liner disc will become compacted between said protrusion on closure top wall and also behind on retaining angle gland which is axially or vertically downwardly from the inside top of closure. The inverted angle serves the purpose to retain the deformed circular liner disc if the cap is threadingly removed from the container neck. Should for any reason the retaining angle not be used for that purpose, a glue surface can and will serve the same purpose as liner retainer, and this is conventionally in usage in a great number of liner applications.

It will readily be appreciated that the I.D. (inside diameter) of the container rim opening is by way of the forming process of the liner under a certain desirable circumferential pressure embracing an axial secondary seal gland of the deformed liner. This in fact is a highly desirable feature since each liner is individually deformed and receives its liquid seal pressure even if considerable variations or diametrical tolerances in the manufacture of the blown container.

It will be appreciated that generally the deformed liner disc is made of suitable material which remains fundamentally in the shape into which it was deformed, however is expected to grow somewhat after cap is removed from container neck. The amount of growth is desirable because by repeated applications of the closure on to the container we have a repeated condition of leak-proofing! This is an improvement invention over my patents as well as other prior art.

Suitable liner materials are as follows:

(a) foamed materials, sandwiched between layers of vinyl polyethylene, polypropolene, aluminum foils, etc.

(b) rubber compounds (c) Plastisol (resin mixed with plasticizes.)

(They are applied in semi-cured state)

(d) low density Polyethylene (e) paper

In above mentioned prior art some secondary seals have their function below the threaded engagement portion as beads, etc., others are too bulky in design, requiring additional plastic material, some are impractical to closure tolerances, or have various other non-feasible implications and practical shortcomings.

A notorious situation is involved when the secondary seal is situated underneath the conventional screw thread finishes as in U.S. Pat. No. 4,138,028 etc., where they cake up the entire thread portions of cap and container.

With the foregoing brief introduction the hazard of the inherent critical leaking dimension becomes apparent. As a further illustration of the actual dimension of such a critical space for leaking of contents; to express it mathematically, a whole revolution of a conventional threaded closure being 360° will travel in vertical distance the amount which is called the "thread pitch."

If the closure which is seated on the liner or primary seal, is unscrewed slightly, therefore lifted from its primary seal, it approaches the child proof safety abutments which are coincidentially registered on closure and container. As an unscrewing closure moves along the thread pitch in unscrewing motion, it will be arrested by the abutments which is considered by definition as the child proof deterrent.

If the above described unscrewing, from primary liner seating to deterrent is $\frac{1}{8}$ of a whole turn, then the critical leakage dimension is one-fifth of the thread pitch.

If the thread pitch is 0.125 of an inch; one-fifth of it is $0.125/5=0.025$ of an inch.

In conclusion the general effectiveness of the secondary seal has to be only an approximate distance of 0.025 inch.

In brief, the present improvement contemplates several embodiments of functional leak proofing while the closure travels the critical leakage dimension in the unscrewing process from the primary seal position to the safety stop position.

It is significant to have the primary seal and the secondary seal functionally connected, so that after the first is relieved immediately the other will function as a consequence thereof.

It is still another object of the present invention to utilize the capping operation to form a new shape of the liner insert which fabricates its own secondary seal in the process.

It is still another object of the present invention that the primary seal and the secondary seal are accomplished by one component which is a deformed conventional liner.

It is yet another object of the invention to provide for secondary seal function in the absence of liners for economical purposes as well as in the presence of liners as may be required by the Food and Drug Administration. In accordance with the above reasoning, one may readily appreciate that the contents of a product can seep into the primary seal and even reach the threaded portion even in shelf life of the package and therefore cake or glue the seals together so that the safety closure functions are impaired by way of requiring more torque force to unscrew same as was originally required to close and tighten the closure. The present invention will prevent the above. A particular hazard is experienced in certain packages, where internal pressure in the container or squeezing of same or dropping the package on the floor may effect seeping of contents into a primary seal, etc.

It is therefore an obvious consequence and one may readily appreciate that primary and secondary seal combinations as taught in this invention are useful in conventional closures as well even without safety closure features.

A further advantage is observed in the embodiment described that the secondary seal operative in vertical H Dimension is functional for repeated openings.

A still further embodiment of the present invention with reference to Drawing FIGS. 5 to 8 a somewhat different liner forming option is taught, having a similar objective to deform a flat circular liner-disc into a new shape so that the new shape of a single liner is utilized in two ways, namely as primary and secondary seal. A circular liner disc is mechanically placed into the closure cap, possibly with a drop of glue, so that it will not fall out when inverted and placed on to the container filled with contents in the cap having a top wall, a skirt with threads for engagement provided has in the inside of top wall a beveled downward configuration, which beveled configuration is the closure portion that will deform the liner disc when container rim is forced on to said liner disc.

In addition to said beveled angle inside the closure, a retaining angle to receive the liner disc for press fit purposes is provided.

The container rim top is shaped in such a manner that it will serve as an individual liner-disc forming tool and its O.D. (outside diameter) is consequently kept smaller in diameter than the bevel edge small diameter of the forming configuration inside the top-wall of the closure.

The O.D. of container neck forming-tool-shape also has an optional slight pressure angle facing downwardly and towards the closure axis.

Now then; when the closure is threadingly moving on to the container neck it will with great force press the liner into a new configuration, by way of its natural resiliency or capability of deformation and will assume a lasting new shape while it remains seated inside the cap on account of the retaining angle abovementioned which is adjacent to the bevel angle inside the top wall of closure. It will remain seated even if the closure is threadingly removed from the container neck. It will now be readily seen that the single liner-disc became converted into a compressed downward gland configuration which is with certain advantages, pressure forming around the container rim forming shape and will consequently perform a sealing means even when the container rim top is not in contact with the top wall of closure.

This function of course can be performed for repeated usage of the package.

As a somewhat similar object of the present invention the Drawing FIGS. 14 to 17 illustrate essentially a function of deforming a liner-disc as the preceding one with the essential difference that the container deforming configuration provides a flared-collar configuration which is somewhat flexible as to downward flexing when forming pressure is applied. It has an advantage for certain usages, that said flexing property is first consummated when closure is threadingly retreating from newly formed liner before it slides on to the folded downward portion of the liner and thereby performing a secondary seal.

In accordance with a still further feature of the present invention, for a great variety of contents a linerless closure is desirable for economic reasons, since liners are costly and as well require assembly cost by way of gluing etc.

The present invention provides for a closure having two separate annular sealing elements FIGS. 19 to 22 so arranged as to engage and seal against two separate areas of the container neck, to, thereby provide a double seal. Such double seals are among inventions of the prior art and are known under the term dynamic lips or valve seals. Such dynamic lips however, have basic functions dissimilar as the ones taught in this invention. Some are under annular pressure when cap is on its primary seal function in axial dimension thereby compressing the said lip against the top rim of the container neck and thereby do not relax to their original molded position on account of plastic memory properties when closure is threadingly removed, therefore repeated usage will no longer provide original equal sealing properties.

In the above mentioned embodiment the critical leakage dimension is not being leakproof as it should be such as explained in the present application of the Uhlig patented closures. FIGS. 19 to 22.

In reference to the five above mentioned Uhlig patents, the term Critical Leakage Dimension is being defined herein.

The dynamic lips arrangements taught in this invention differ in function in the following manner.

In reference to FIGS. 19 to 22, a linerless closure for externally threaded container necks having an annular rim of substantial diameter of the mouth thereof, said cap having a top wall and an outer cylindrical skirt or frustro conical skirt being threaded at its lower portion to engage with the threads on the container, an annular rib or dynamic lip, depending from the underside of the top of said skirt, said rib being substantially of greater thickness where it grows integrally out of the underside of the closure top wall while said lip or rib tapers to practically zero thickness in its cross-section, said entire circular rib or lip tapering downwards and towards the skirt of said closure at an angle indicated as $\beta$ (Beta) in the referred to drawing figure, therefore having said lower zero cross-section thickness in its circular diametrical circumference greater than its base on the top wall of the closure. Now then, the externally threaded container neck rim has a bevel edge on its inner diameter which is the mouth of the container. Said bevel edge has the purposes and function to spread out the downwardly approaching dynamic lip or rib for a strictly temporary enlargement of said rib circular lower portion. Said bevel edge has an approximate 45° angle $\alpha$ (Alpha) which 45° angle serves as a guide or same function to lead the cynamic lip into yet another functional bevel angle inside the container neck mouth. This other functional bevel angle inside the container neck mouth is defined as inclined angle is now of the same angle as the above referred to dynamic lip angle $\beta$ (Beta) with designedly imposed slight pressure for leak-proofing of said fitting angle surfaces. It will be appreciated that the pressure imposed for such fitting has the plastic memory as resilient properties in their favor, while it is practically resting in its almost molded shape and therefore will be pressure charged even in prolonged shelf life. Optional in the same embodiment a ring liner is glued into the cap, the primary seal seating is possibly improved.

When this closure is threadingly removed from the container neck the secondary dynamic lip angle $\beta$ (Beta) is sliding effortlessly and smoothly along its same angle $\beta$ (Beta) inclined angle inside the container neck mouth and slides over the 45° angle bevel edge sealing liquid tight as secondary seal all the way while the primary seal is out of its function.

Illustration in FIGS. 23 to 26 show the said dynamic lip is pointing in its frustro-conical configuration towards the center line or axis of the package, having all parts and functions just accordingly changed, while the ring liner as in FIG. 22 becomes a flat conventional liner which can be glued in or pressed in.

NUMERICAL IDENTIFICATION OF PARTS AND EXPLANATION OF FUNCTIONS

Figure 1:
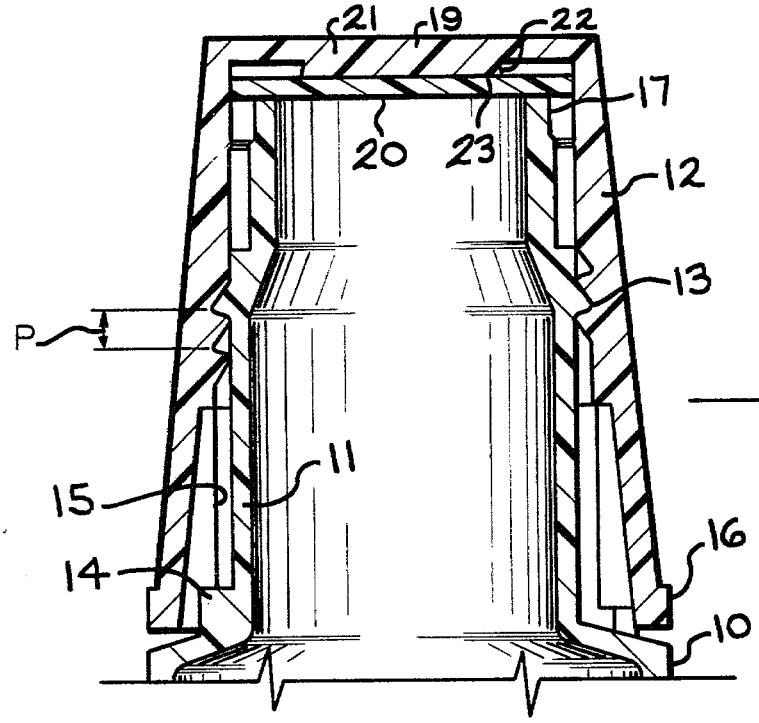
FIG. 1 shows a central axial section of a container and a container-closure according to one embodiment of the present invention.

Turning firstly to the embodiment shown in FIGS. 1–4, reference numeral 10 designates the top portion of a container body which is integral with an upstanding neck portion 11. A closure 12 is threadingly secured to the neck portion 11 by thread 13 having a given pitch P. The shown container and closure 12 is of the type designed to prevent the release of the closure 12 from the bottle neck 11, unless a mindful dextrous manipulation is effected with the closure. The child-proof mechanism is known and is indicated in a diagrammatic way only. Reference may be had in this context to my issued U.S. patents, in which various mechanisms of the kind are disclosed. For the purpose of describing the present invention, it will suffice to refer to a protrusion 14 integral with the body of the container and disposed at the lower end of the neck portion 11. The protrusion 14 is arranged for engagement with a protrusion 15 directed radially inwardly. In order to release the closure 12 shown in FIG. 1 and assuming that the protrusion 15 engages protrusion 14, it is necessary to deflect the lower part or skirt 16 by pressing the closure 12 radially inwardly, from the right to the left of FIG. 1.

The uppermost radially outward portion of the neck section 11 is designated with reference numeral 17. The inside wall section 18 is also generally cylindric.

Interposed between the top rim of the neck portion 11 and the bottom section 19 of the closure is a circular liner 20 whose outside diameter generally corresponds to the inside diameter of the closure near the bottom section 19.

Figure 2:
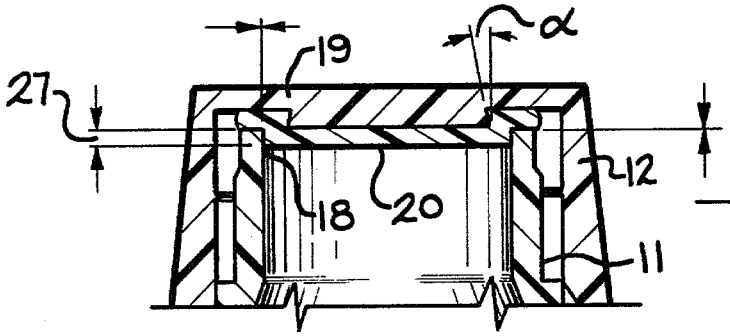
FIG. 2 is a partial section as in FIG. 1, showing the closure and the container-neck in a tight engagement.
Figure 3:
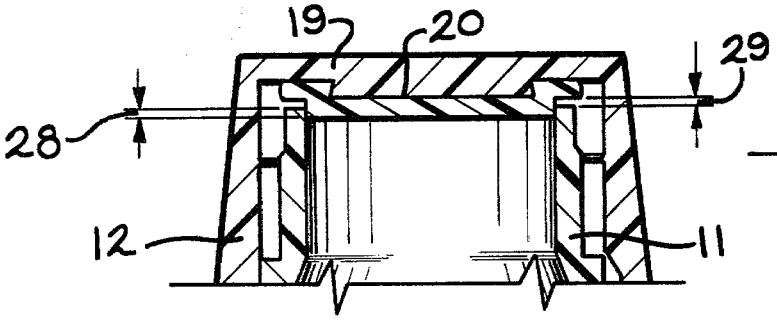
FIG. 3 is a section similar to FIG. 2 but showing the closure partly released with only the secondary seal being effective.
Figure 4:
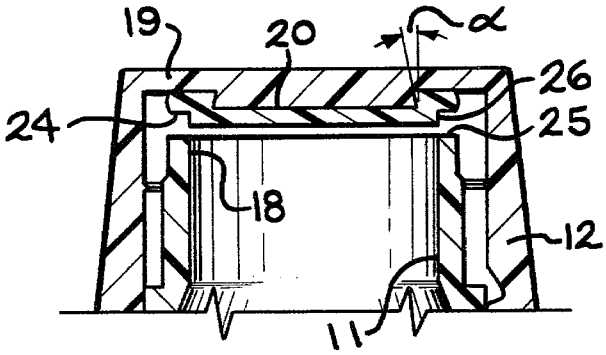
FIG. 4 is a section similar to FIG. 2 showing the mutual position between the container-neck and the closure upon overcoming the lock of child-proof locking abutments.
Figure 5:
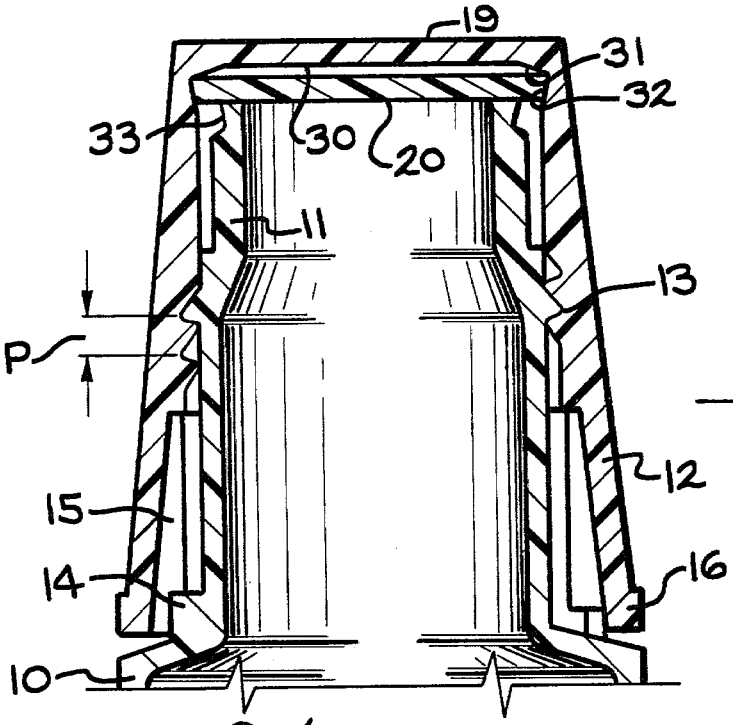
FIGS. 5–8 are sectional views similar to those of FIGS. 1–4 but showing a second embodiment of the present invention.
Figure 6:
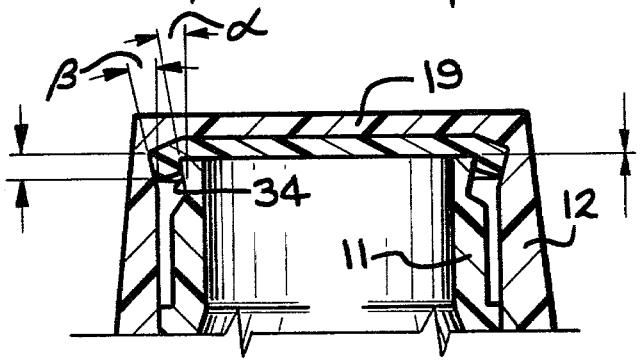
Figure 7:
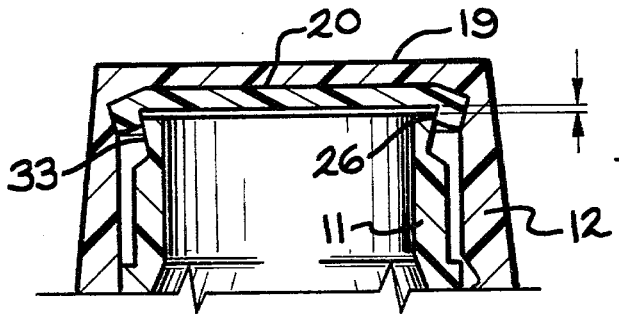
Figure 8:
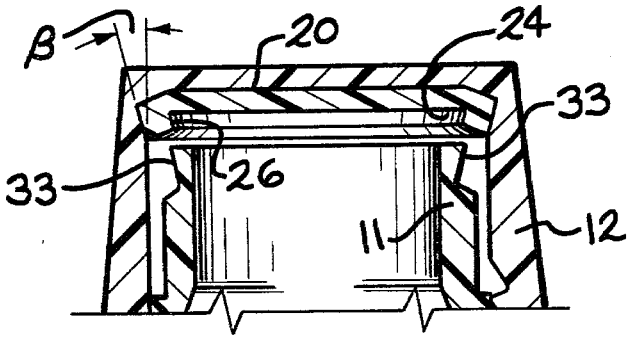
Figure 9:
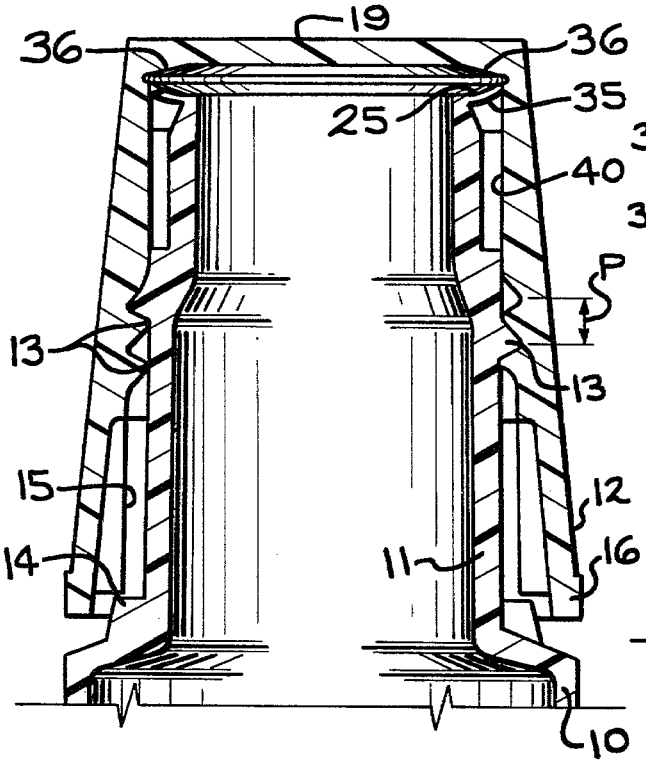
FIGS. 9–12 are sectional views similar to those of FIGS. 1–4 but showing another embodiment of the present invention.
Figure 13:
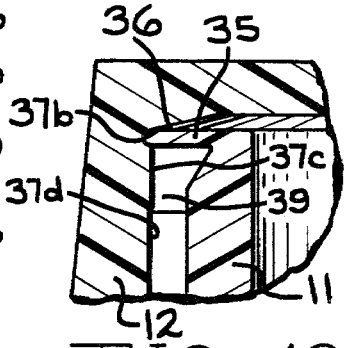
FIG. 13 is detail XIII of FIG. 11.
Figure 10:
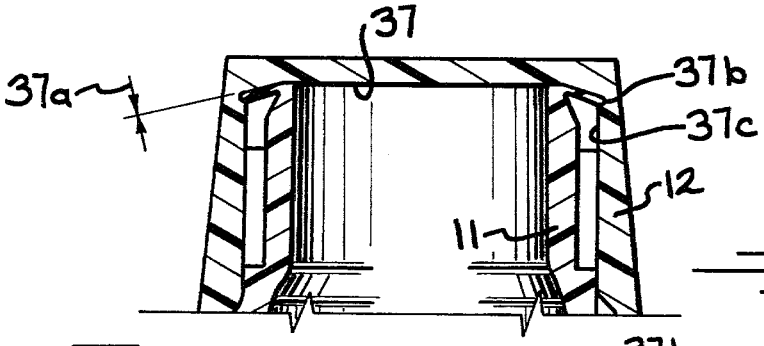
Figure 11:
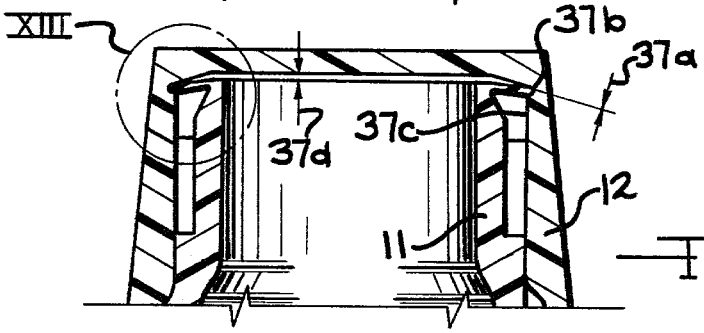
Figure 12:
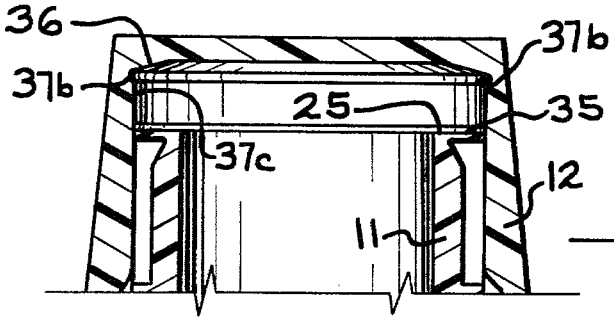
Figure 14:
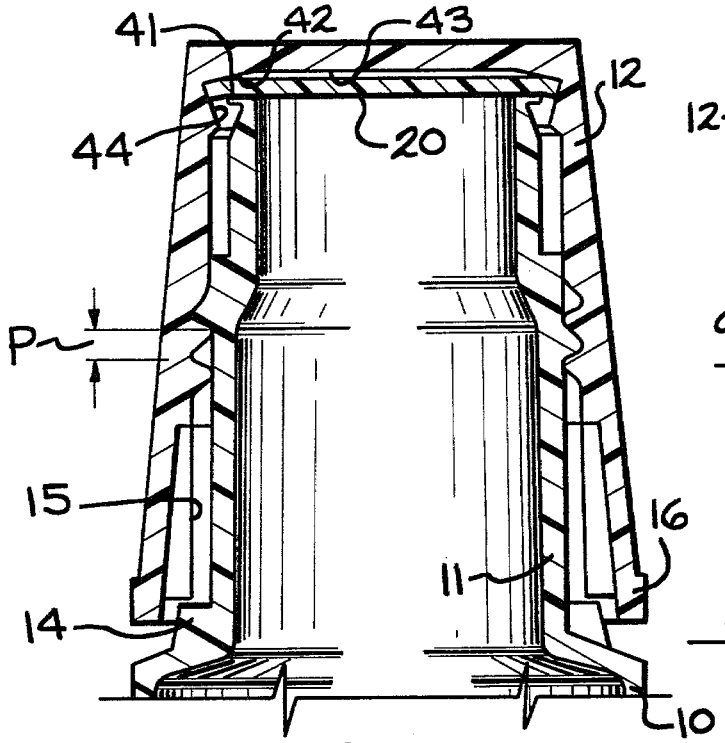
FIGS. 14–17 are cross-sectional views similar to those of FIGS. 1–4 but showing still another embodiment of the present invention.
Figure 18:
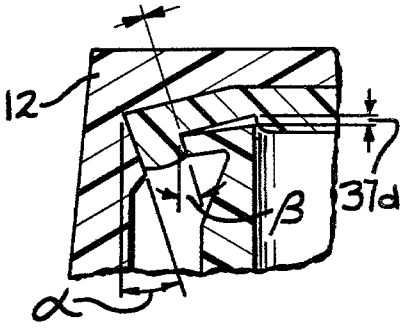
FIG. 18 is detail XVIII of FIG. 16.
Figure 15:
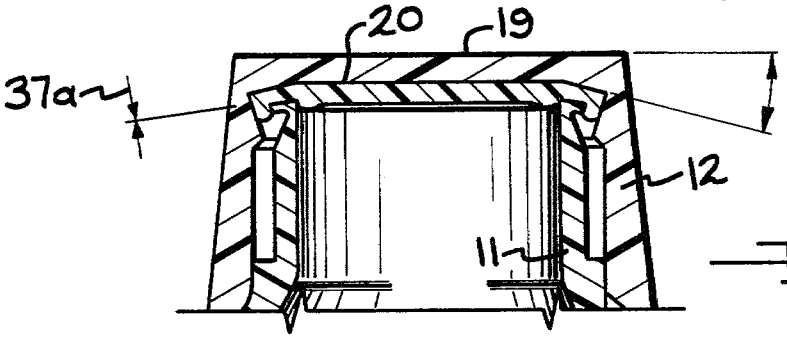
Figure 16:
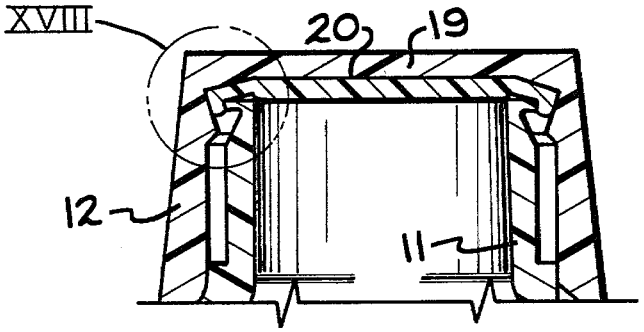
Figure 17:
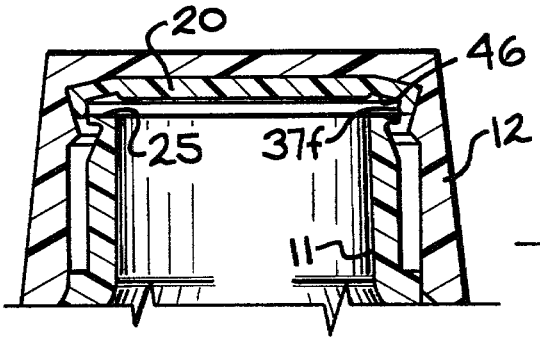
Figure 19:
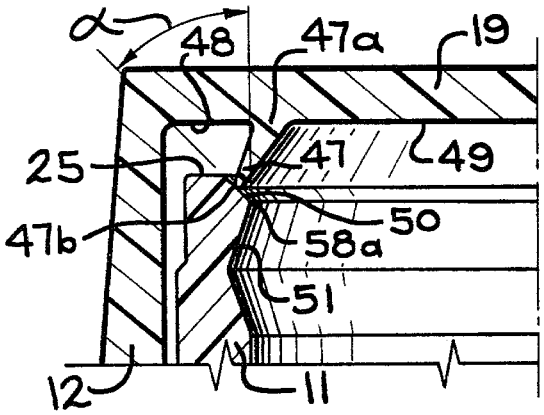
FIGS. 19–22 are partial sectional views similar to those of FIGS. 1–4 but showing only one half of the respective partial sections, the last mentioned series of figures showing yet another embodiment of the present invention.
Figure 20:
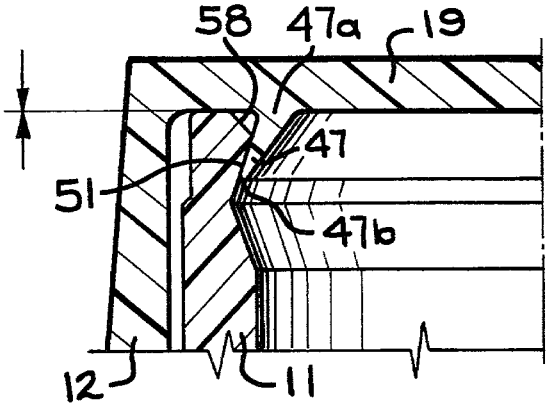
Figure 21:
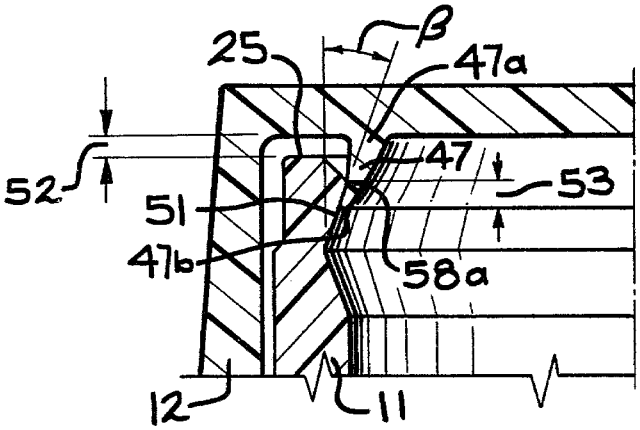
Figure 22:
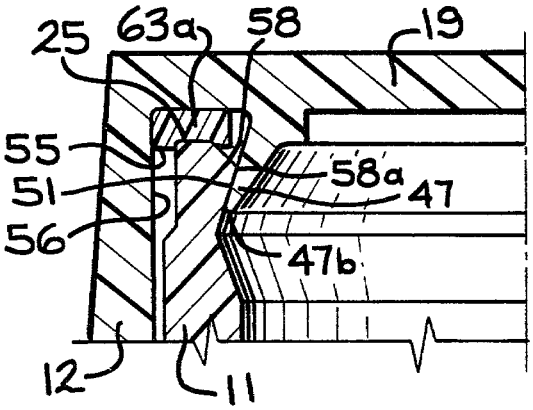
Figure 23:
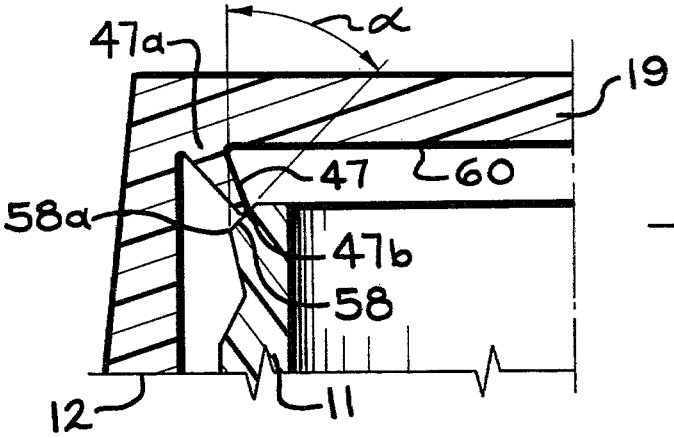
FIGS. 23–29 show sectional views similar to those of FIGS. 19–22 but showing a still further embodiment of the present invention.
Figure 24:
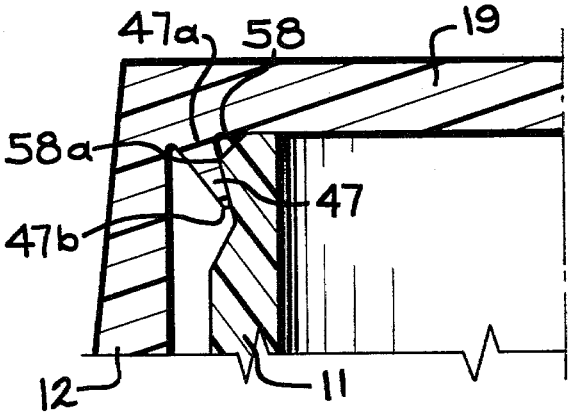
Figure 25:
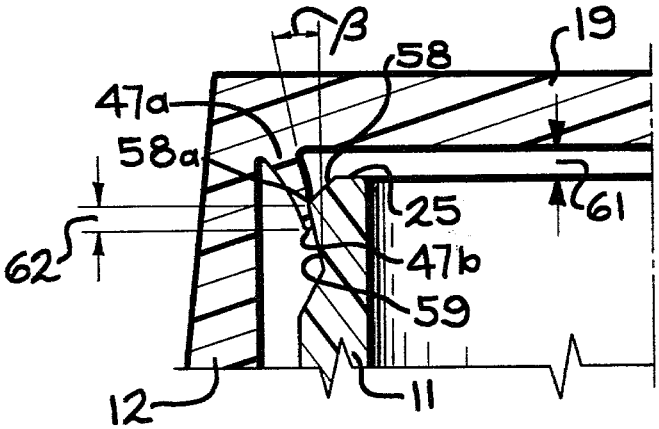
Figure 26:
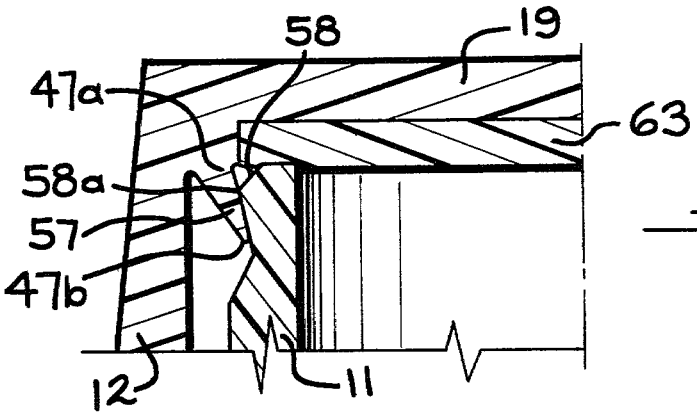

The liner has a suitable thickness and is made of a material capable to be pressure shaped from a generally flat state shown in FIG. 1 to an axially deformed state which will be referred to in greater detail as the description proceeds, with reference to FIGS. 2, 3 and 4. In other words, the liner has the capability of being deformed and to retain its deformed shape, while the resiliency of the liner, required for sealing purposes, remains virtually unchanged or is changed to a negligible degree. A suitable material from which the liner can be made is well known in the art of container closures.

Figure 27:
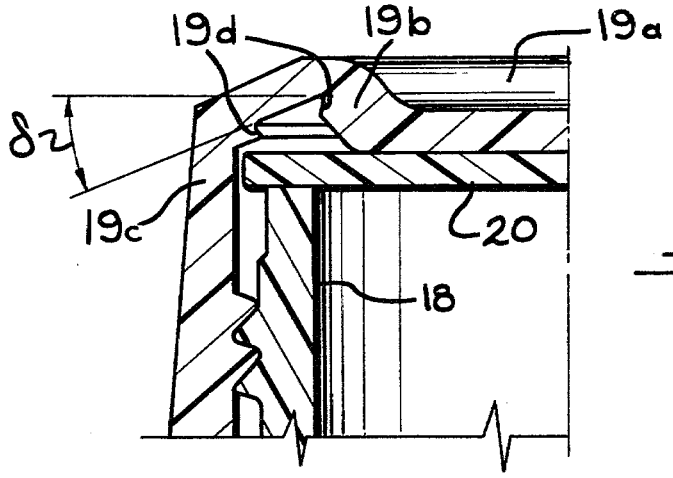
Figure 28:
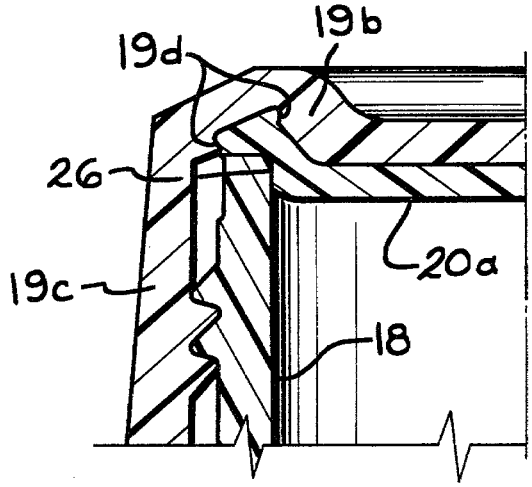
Figure 29:
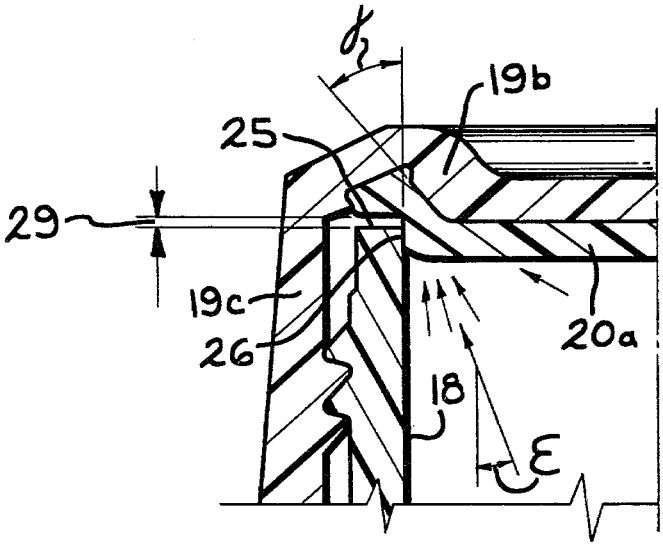

Turning to Drawing FIGS. 27 to 29, this is an embodiment somewhat similar to FIGS. 1 to 8. The basic components of closure and container are referred to with reference to FIGS. 1 to 4 with the same reference numerals.

In this embodiment the closure top wall has a plastic material safer (**19*a*) built in. A reinforced cross-section 19*b*, being of wall thickness greater then the typical cross sections (19*c*) for purpose of withstanding internal container pressure exerted from within the container. A line 20 is being deformed or compressed somewhat similar as in FIGS. 1 to 8**.

A compression angle Delta is provided to receive the newly shaped liner **20*a*, said newly shaped liner 20*a* will be permanently assembled retaining angle 19*d* when container neck rim 25 assumes primary sealing relationship with liner 20*a*** and angle $\delta$ Delta.

An internal pressure wedge-angle $\epsilon$ Epsilon is indicated in FIG. 29 illustrating how internal pressure exerts upon liner **20*a*, while said liner is kept in the position by retaining angle 19*d*, while container rim inside Diameter 18 is partially removed from primary seal sealing by a distance 29 or typical FIG. 3. sliding on secondary seal gland 26** which is providing for secondary seal function.

I claim:

1. In combination:

a container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to sealingly contact said rim, (2) a connected depending skirt adapted to threadingly engage said threads on said neck of said container, said closure and container each including, in coincident registration with said threads, cooperatively engageable and disengageable lock abutments, and spacing means for allowing rotational tightening beyond that normally achieving locking engagement of container as would induce distortion or stress in either said closure or container;

means associated with said closure adapted for purposeful dextrous manipulation to effect disengagement of said abutments, and internal forming provisions designedly configurated inside of closure top wall and container top rim defined-opening to draw-form an inserted resilient liner-disc-member sandwiched between said internal forming provisions into a new shape configuration when closure is first time threadingly applied upon container neck, which new shape is individually fashioned and receives downwardly drawn gland surfaces, which surfaces serve as secondary sealing means, said sealing means are functionally under circumferentially embracing pressure by way of individually manufactured new liner component.

2. In combination:

a container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to sealingly contact said rim, (2) a connected depending skirt adapted to threadingly engage said threads on said neck of said container, said closure and container each including, in coincident registration with said threads, cooperatively engageable and disengageable lock abutments, and spacing means for allowing rotational tightening beyond that normally achieving locking engagement of contrainer as would induce distortion or stress in either said closure or container;

means associated with said closure adapted for purposeful dextrous manipulation to effect disengagement of said abutments, and internal forming provisions designedly configurated inside of closure top wall and container rim-defined opening, to draw-form an inserted resilient liner disc member sandwiched between said internal forming provisions into a new shape configuration, which new shape is individually fashioned and produces downwardly drawn gland surfaces, which surfaces serve as secondary sealing means, said sealing means are functionally under circumferential embracing pressure by way of individually manufactured new liner component, and said forming provision inside of closure top wall is in the form of a downwardly extending cylindrical or inverted retaining angle forming protrusion, said protrusion being approximately two times the liner thickness less in O. D. (outside diameter) than is the I. D. (inside diameter) of container neck-rim, said liner disc being draw formed into new shape as closure and container neck-rim treadingly approaching becomes home-seated when screwed together, said newly shaped liner disc has newly fashioned downwardly drawn gland surfaces, said surfaces are functionally under circumferentially embracing pressure by way of individually new manufactured liner configuration, said surfaces serve as secondary-axially functional-sealing-means while said container rim embraced with sealing pressure slidingly retains such sealing pressure property by repeated usage of said closure and container components.

3. As claimed above in claim 2, said newly shaped downwardly drawn circular liner disc being retainably and permanently assembled to closure top wall on behalf of retaining angle of said downwardly inwardly inclined forming provision inside of closure top wall.

4. In combination:

a container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to seemingly contact said rim, (2) a connected depending skirt having threads formed on the inner surface of said skirt adapted to threadingly engage said threads on said neck of said container, said closure and container each including, in coincident registration with said threads, cooperatively engageable and disengageable lock abutments, and spacing means for allowing rotational tightening beyond that normally achieving locking engagement of said lock abutments without any contact of said closure or container as would induce distortion or stress in either said closure or container;

means associated with said closure adapted for purposeful dextrous manipulation to effect disengagement of said abutments, and a horizontally extending flared collar, being of flexible, bendable nature integrally-formed on to plastic container top rim defined opening, said flared collar, its circumferential peripheral portion being flexibly bendable downwardly when it fully contacts a beveled surface inside closure top wall while said flared collar is sufficiently flexible to bend in upward direction as well upon retreating from said top wall of closure while pressure sliding downwardly in its upwards bent condition along a generally cylindrical vertical gland providing secondary sealing property to prevent leakage for a designedly predetermined axial distance.

5. A closure container combination as claimed in claim 4 having a subatantially flat resilient liner-disc-member sandwiched between said flat and beveled top wall of said closure and said flared collar on container rim-defined opening, said liner disc being draw-formed into new shape as closure and container neck rim are being threadingly home-seated, said newly shaped liner disc has received individually new-fashioned downwardly drawn gland surfaces, said surfaces serve as secondary sealing means while said specifically described forming provisions are retreating upon unscrewing of closure from container neck rim, while such secondary circumferentially embracing-sealing property has repeated usage for said closure and container components.

6. A closure container combination as claimed in claims 4 and 5 having a substantially flat resilient liner-disc-member sandwiched between said flat and beveled top wall of said closure and a generally cylindrical container-neck top rim-configuration situated below in line with the beginning of beveling of closure top wall inside of closure, said liner disc being draw-formed into new shape as closure and container neck rim are being home-seated, said newly shaped liner disc has received individually fashioned downwardly drawn gland surfaces, said surfaces serve as secondary sealing means while said specifically described forming provisions are retreating upon unscrewing of closure container neck rim, while such secondary circumferentially embracing sealing property has repeated usage for repeated embracing pressure upon said neck rim of container neck.

7. In combination:

a container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to sealingly contact said rim, (2) a connected depending skirt having threads formed on the inner surface of said skirt adapted to threadingly engage said threads on said neck of said container, said closure and container each including, in coincident registration with said threads, cooperatively engageable and disengageable lock abutments, and spacing means for allowing rotation tightening beyond that normally achieving locking engagement of said lock abutments without any contact of said closure or container;

means associated with said closure adapted for purposeful dextrous manipulation to effect disengagement of said abutments, and a circular dynamic-lip protrusion integrally connected to the closure top wall, said flexible dynamic lip being inclined downwardly and outwardly, having a functional capability of temporarily being circumferentially bendable inwardly as well as outwardly, depending upon guiding or spreading influence of threadingly approachable container rim-top, said rim top having a beveled approximate 45° angle or other designedly suitable angle provided in the I. D. (inside diameter) of said container rim-defined opening, following said beveled angle is provided an inclined gliding angle, inclining reversely to said beveled angle in a downwardly pointing direction being the same direction as said dynamic lip inside closure top wall with approximately equal angle of downward inclination, as said closure-container components threadingly approach each other, said dynamic lip capable of ending in two ways upon gliding over guiding beveled surfaces on container neck I. D. configuration, it is performing such two way bending over said sliding angle provisions on container-neck-rim identified as beveled angle and opposite inclined angle, said protruding dynamic lip finally, smoothly and designedly settles in its natural angle equal to the inclined angle of neck inclined angle postion as said closure container components reach contact seal seating position on its primary sealing means, and as such provides a secondary sealing means in addition to said primary contact sealing means, upon threadingly retreating of container closure components the reverse functions apply, always having the secondary sealing means in liquid stripper function while bending over two directions of bevel angle and inclined angle while the primary seal is operative only upon fully closed position and in such position is additionally operative in conjunction with the secondary sealing-means, which in closed position has contact inclined angle embracing sealing pressure.

8. A closure and container combination as claimed in claim 7 having primary and secondary sealing means reversed to be pointing in its inclination angle of said dynamic lip toward the center-line of package and being operative upon the O.D. (outside diameter) instead of the I. D. (inside diameter).

9. A closure and container combination as claimed in claims 7 and 8 having optional primary seal ring liner or conventional liner application, respectively inserted.

10. A container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to sealingly contact said rim, (2) a connected depending skirt adapted to threadingly engage said threads on said neck of said container, internal forming provisions designedly configurated inside of closure top wall and container top rim defined-opening to draw-form as inserted resilient liner-disc-member sandwiched between said internal forming provisions into a new shape configuration when closure is first time threadingly applied upon container neck, which new shape is individually fashioned and receives downwardly drawn gland surfaces, which surfaces serve as secondary sealing means, said sealing means are functionally under circumferentially embracing pressure by way of individually manufactured new liner component.

11. A container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to seemingly contact said rim, (2) a connected depending skirt adapted to threadingly engage said threads on said neck of said container, internal forming provisions designedly configurated inside of closure top wall and container rim-defined opening, to draw-form an inserted resilient liner disc member sandwiched between said internal forming provisions into a new shape configuration, which new shape is individually fashioned and produces downwardly drawn gland surfaces, which surfaces serve as secondary sealing means, said sealing means are functionally under circumferential embracing pressure by way of individually manufactured new liner component, and said forming provision inside of closure top wall is in the form of a downwardly extending cylindrical or inverted retaining angle forming protrusion, said protrusion being approximately two times the liner thickness less in O.D. (outside diameter) than is the I.D. (inside diameter) of container neck-rim, said liner disc being drawn formed into new shape as closure and container neck-rim threadingly approaching becomes home seated when screwed together, said newly shaped liner disc has newly fashioned downwardly drawn gland surfaces, said surfaces are functionally under circumferentially embracing pressure by way of individually new manufactured liner configuration, said surfaces serve as secondary-axially functional-sealing-means while said container rim embraced with sealing pressure slidingly retains such sealing pressure property by repeated usage of said closure and container components.

12. As claimed above in claim 11, said newly shaped downwardly drawn circular liner disc being retainably and permanently assembled to closure top wall on behalf of retaining angle of said downwardly inwardly inclined forming provision inside of closure top wall.

13. A container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to seemingly contact said rim, (2) a connected depending skirt having threads formed on the inner surface of said skirt adapted to threadingly engage said threads on said neck of said container, a horizontally extending flared collar, being of flexible, bendable nature integrally-formed on to plastic container top rim defined opening, said flared collar, its circumferential peripheral portion being flexibly bendable downwardly when it fully contacts a beveled surface inside closure top wall while said flared collar is sufficiently flexible to bend in upward direction as well upon retreating from said top wall of closure while pressure sliding downwardly in its upwards bent condition along a generally cylindrical vertical gland providing secondary sealing property to prevent leakage for a designedly pre-determined axial distance.

14. A closure container combination as claimed in claim 12 having a substantially flat resilient liner-disc-member sandwiched between said flat and beveled top wall of said closure and said flared collar on container rim-defined opening, said liner disc being draw-formed into new shape as closure and container neck rim are being threadingly home seated, said newly shaped liner disc has received individually new-fashioned downwardly drawn gland surfaces, said surfaces serve as secondary sealing means, while said specifically described forming provisions are retreating upon unscrewing of closure from container neck rim, while such secondary circumferentially embracing-sealing property has repeated usage for said closure and container components.

15. A closure container combination as claimed in claims 14 and 15 having a substantially falt resilient liner-disc-member sandwiched between said flat and beveled top wall of said closure and a generally cylindrical container-neck top rim-configuration situated below in line with the beginning of beveling of closure top wall inside of closure, said liner disc being draw-formed into new shape as closure and container neck rim are being home-seated, said newly shaped liner disc has received individually fashioned downwardly drawn gland surfaces, said surfaces serve as secondary sealing means while said specifically described forming provisions are retreating upon unscrewing of closure container neck rim, while such secondary circumferentially embracing sealing property has repeated usage for repeated embracing pressure upon said neck rim of container neck.

16. A container including (1) a principal hollow body serving as a receptacle and (2) a connected upstanding neck terminating in a rim-defined opening and having threads formed on the exterior annular surface of said neck for threaded engagement by cooperating thread means formed on a suitable closure, a closure member including (1) a top wall spanning said rim-defined opening, said top wall being adapted to sealingly contact said rim, (2) a connected depending skirt adapted to threadingly engage said threads on said neck of said container, a circular dynamic-lip protrusion integrally connected to the closure top wall, said flexible dynamic lip being inclined downwardly and outwardly, having a functional capability of temporarily being circumferentially bendable inwardly as well as outwardly, depending upon guiding or spreading influence of threadingly approachable container rim-top, said rim top having a beveled approximate 45° angle or other designedly suitable angle provided in the I. D. (inside diameter) of said container rim-defined opening, following said beveled angle is provided an inclined gliding angle, inclining reversely to said beveled angle in a downwardly pointing direction being the same direction as said dynamic lip inside closure top wall with approximately equal angle of downward inclination, as said closure-container components threadingly approach each other, said dynamic lip capable of bending in two ways upon gliding over guiding beveled surfaces on container neck I. D. configuration, it is performing such two way bending over said sliding angle provisions on container-neck-rim identified as beveled angle and opposite inclined angle, said protruding dynamic lip finally, smoothly and designedly settles in its natural angle equal to the inclined angle of neck inclined angle position as said closure container components reach contact seal seating position on its primary sealing means in addition to said primary contact sealing means, upon threadingly retreating of container closure components the reverse functions apply, always having the secondary sealing means in liquid stripper function while bending over two directions of bevel angle and inclined angle while the primary seal is operative only upon fully closed position and in such position is additionally operative in conjunction with the secondary sealing-means, which in closed position has contact inclined angle embracing sealing pressure.

17. A closure and container combination as claimed in claim 16 having primary and secondary sealing means reversed to be pointing in its inclination angle of said dynamic lip toward the center-line of package and being operative upon the O.D. (outside diameter) instead of the I.d. (inside diameter).

18. A closure and container combination as claimed in claims 16 and 17 having optional primary seal ring liner or conventional liner application, respectively inserted.

19. A closure for use on a container having an upstanding neck terminating in a rim-defined opening, said closure including a top wall spanning such opening and a depending skirt, a first sealing means for sealing such container neck and said closure when said container and said closure are fully engaged with one another and a second sealing means between said closure and said container effective upon limited axial movement of such neck away from said top wall.

20. A closure as claimed in claim 19 including a resilient deformable liner positioned adjacent said top wall, said first sealing means comprising a first sealing surface defined by said liner adjacent the upper surface of such container neck and said second sealing means comprising a downwardly extending surface of said liner and a complementary and mating surface on such neck.

* * * * *

UNITED STATES PATENT AND TRADEMARK OFFICE

CERTIFICATE OF CORRECTION

PATENT NO. : 4,351,443

DATED : September 28, 1982

INVENTOR(S) : Gerhardt E. Uhlig

It is certified that error appears in the above—identified patent and that said Letters Patent is hereby corrected as shown below:

Column 1, line 27, "commin" should be --common--.

Column 1, line 51, "caking or" should be --caking of--.

Column 2, line 50, "constant" should be --container--.

Column 3, line 64, "1/8" should be --1/5--.

Column 4, line 6, "critical leakage" should be --critical vertical leakage--.

Column 13, line 26, "falt" should be --flat--.

Column 14, line 38, "I.d." should be --I.D.--.

Signed and Sealed this

*Twenty-second* Day of *February 1983*

[SEAL]

*Attest:*

GERALD J. MOSSINGHOFF

*Attesting Officer*

*Commissioner of Patents and Trademarks*